US011344940B2

(12) United States Patent
Iwase et al.

(10) Patent No.: US 11,344,940 B2
(45) Date of Patent: May 31, 2022

(54) MANUFACTURING DEVICE FOR BENT PIPE AND METHOD OF MANUFACTURING BENT PIPE

(71) Applicant: FUTABA INDUSTRIAL CO., LTD., Aichi (JP)

(72) Inventors: Hiro Iwase, Aichi (JP); Koichiro Yamamoto, Aichi (JP); Takashi Sakurai, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 54 days.

(21) Appl. No.: 17/111,668

(22) Filed: Dec. 4, 2020

(65) Prior Publication Data

US 2021/0220894 A1 Jul. 22, 2021

(30) Foreign Application Priority Data

Jan. 22, 2020 (JP) ..... JP2020-008476

(51) Int. Cl.

| | |
|---|---|
| ***B21D 9/00*** | (2006.01) |
| ***B21D 11/07*** | (2006.01) |
| ***B21D 9/05*** | (2006.01) |
| ***B21D 7/024*** | (2006.01) |
| ***B21D 9/07*** | (2006.01) |

(52) U.S. Cl.

CPC ..... *B21D 11/07* (2013.01); *B21D 7/024* (2013.01); *B21D 9/05* (2013.01); *B21D 9/073* (2013.01)

(58) Field of Classification Search

CPC . B21D 7/024; B21D 7/03; B21D 7/04; B21D 9/01; B21D 9/03; B21D 9/04; B21D 9/05; B21D 9/07; B21D 9/073; B21D 9/16; B21D 11/07

See application file for complete search history.

(56) References Cited

U.S. PATENT DOCUMENTS

| | | | | |
|---|---|---|---|---|
| 5,749,255 | A | 5/1998 | Arai | |
| 5,937,686 | A * | 8/1999 | Arai | B21D 9/073 72/370.01 |
| 7,131,313 | B2 * | 11/2006 | Nakazato | B21D 9/073 72/149 |
| 2014/0007639 | A1 | 1/2014 | Schaefer | |

FOREIGN PATENT DOCUMENTS

| | | | |
|---|---|---|---|
| JP | H09155456 | A | 6/1997 |
| JP | H10118719 | A | 5/1998 |
| JP | 2013526408 | A | 6/2013 |

* cited by examiner

*Primary Examiner* — Debra M Sullivan

(74) *Attorney, Agent, or Firm* — David D. Brush; Westman, Champlin & Koehler, P.A.

(57) ABSTRACT

One aspect of the present disclosure is a manufacturing device by which the bent pipe is obtained by bending a double pipe. The device includes inner and intermediate core metals, a bending mold, and a controller. The controller executes: a first bending process in which first and second pipes are bent by the bending mold in a first direction in a first area of the double pipe where the inner and intermediate core metals are placed; a second bending process in which the first and second pipes are bent, after the first bending process, by the bending mold in a second direction in a second area of the double pipe where the inner and intermediate core metals are placed; and a first bending-back process in which the second pipe is bent, after the first bending process, in a direction opposite to the first direction in the first area.

6 Claims, 14 Drawing Sheets

MANUFACTURING DEVICE FOR BENT PIPE AND METHOD OF MANUFACTURING BENT PIPE

CROSS-REFERENCE TO RELATED APPLICATIONS

This application claims the benefit of Japanese Patent Application No. 2020-008476 filed on Jan. 22, 2020 with the Japan Patent Office, the entire disclosure of which is incorporated herein by reference.

BACKGROUND

The present disclosure relates to a manufacturing device for a bent pipe and a method of manufacturing a bent pipe.

There has been known a method of bending a double pipe in a specified direction at multiple points by externally pressing a bending mold against the double pipe containing a core metal (that is, a mandrel) therein and moving the bending mold (Japanese Unexamined Patent Application Publication No. H9-155456).

SUMMARY

The bending process of the double pipe is applied to a portion of the double pipe in which the core metal is placed between an inner pipe and an outer pipe. Thus, a gap between the inner pipe and the outer pipe is maintained. In a second or later bending process, however, a portion of the double pipe, which has been already bent, is not provided with a core metal.

Thus, the second or later bending process causes the inner pipe to be pulled and to extend in an axial direction at the portion that has been bent in the previous bending process. Consequently, bending of the inner pipe and bending of the outer pipe are not coincide with each other, which reduces the gap between the inner pipe and the outer pipe.

In one aspect of the present disclosure, it is desirable to provide a manufacturing device for a bent pipe that can bend a double pipe multiple times while maintaining a gap between an inner pipe and an outer pipe.

One aspect of the present disclosure is a manufacturing device for a bent pipe by which the bent pipe is obtained by bending a double pipe with a first pipe and a second pipe containing therein the first pipe. The manufacturing device for a bent pipe comprises: an inner core metal configured to be placed in the first pipe; an intermediate core metal configured to be placed between the first pipe and the second pipe; a bending mold configured to bend the double pipe; and a controller.

The controller is configured to execute: a first bending process in which the first pipe and the second pipe are bent by the bending mold in a first direction in a first area of the double pipe where the inner core metal and the intermediate core metal are placed; a second bending process in which the first pipe and the second pipe are bent, after the first bending process, by the bending mold in a second direction in a second area of the double pipe where the inner core metal and the intermediate core metal are placed; and a first bending-back process in which the second pipe is bent, after the first bending process, in a direction opposite to the first direction in the first area.

With the configuration described above, reduction of a gap between the first pipe and the second pipe, which is generated in the first area during the second bending process, can be compensated by the bending-back process in which the second pipe is bent in the opposite direction. Thus, it is possible to bend the double pipe multiple times while maintaining the gap between the first pipe and the second pipe.

In the above aspect of the present disclosure, the controller may be configured to execute a second bending-back process, in which the second pipe is bent in a direction opposite to the second direction in the second area, after the second bending process. With this configuration, the gap reduced between the first pipe and the second pipe in the second area can be also compensated.

In the above aspect of the present disclosure, the controller may be configured to execute the first bending-back process after the second bending process. With this configuration, the double pipe can be bent back while being placed in a specified orientation after the first bending process and the second bending process are completed. Thus, the gap between the first pipe and the second pipe can be easily compensated.

In the above aspect of the present disclosure, the manufacturing device may further comprise a bending-back mold that is configured to bend the second pipe by rotating the second pipe about the center of the first area as a fulcrum. The controller may be configured to bend the second pipe by the bending-back mold in the first bending-back process. With these configurations, the second pipe is bent back in the area in which the first pipe is deformed greatly and therefore, the gap between the first pipe and the second pipe can be more precisely left.

In the above aspect of the present disclosure, the controller may be configured to execute the first bending-back process before the second bending process. With this configuration, the double pipe can be bent back while being placed in the bending mold, thereby shortening the manufacturing process of the bent pipe.

Another aspect of the present disclosure is a method of manufacturing a bent pipe in which the bent pipe is obtained by bending a double pipe with a first pipe and a second pipe containing therein the first pipe. The method of manufacturing a bent pipe comprises: placing an inner core metal in the first pipe and placing an intermediate core metal between the first pipe and the second pipe; bending the first pipe and the second pipe by a bending mold in a first direction in a first area of the double pipe where the inner core metal and the intermediate core metal are placed; bending the first pipe and the second pipe, after the bending in the first direction, by the bending mold in a second direction in a second area of the double pipe where the inner core metal and the intermediate core metal are placed; and bending-back the second pipe, after the bending in the first direction, in a direction opposite to the first direction in the first area.

With the configuration described above, the gap reduced between the first pipe and the second pipe in the first area during the bending in the second area can be modified by the bending-back. Thus, it is possible to bend the double pipe multiple times while maintaining the gap between the first pipe and the second pipe.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. First Embodiment

1-1. Configuration

Figure 1:
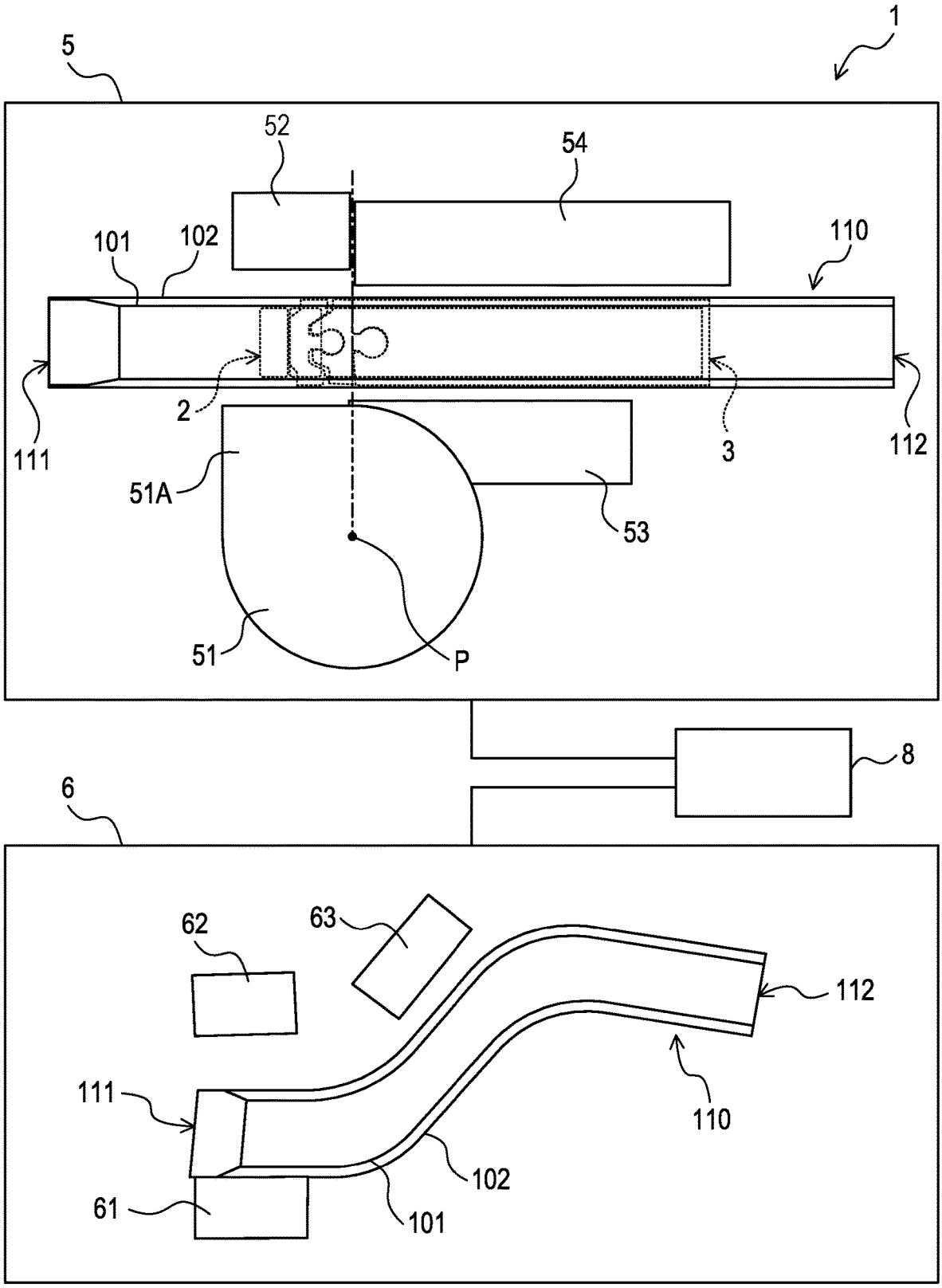
FIG. 1 is a schematic diagram of a manufacturing device for a bent pipe according to an embodiment.

A device 1 for manufacturing a bent pipe (hereinafter, simply referred to as "manufacturing device 1") shown in FIG. 1 is a device for obtaining a bent pipe by bending a straight pipe.

The manufacturing device 1 of the present embodiment manufactures a bent pipe from a double pipe 110 that comprises a first pipe 101 and a second pipe 102. The second pipe 102 is placed to enclose an outer-circumferential surface of the first pipe 101. In other words, the second pipe 102 contains therein the first pipe 101. FIG. 1 and other figures show the double pipe 110 in a cross-section.

The first pipe 101 and the second pipe 102 are joined to each other at a first end 111 of the double pipe 110. At a second end 112 situated opposite to the first end 111, however, the first pipe 101 and the second pipe 102 are not joined to each other.

The first pipe 101 and the second pipe 102 each have a circular outer shape in a cross-section perpendicular to respective central axes of the first pipe 101 and the second pipe 102. In the present embodiment, the central axis of the first pipe 101 and the central axis of the second pipe 102 coincide with each other; however, the respective central axes of the first pipe 101 and the second pipe 102 may not necessarily coincide with each other.

The manufacturing device 1 simultaneously bends the first pipe 101 and the second pipe 102 while leaving a gap therebetween, to thereby obtain the bent double pipe 110 as the bent pipe.

The manufacturing device 1 comprises an inner core metal 2, an intermediate core metal 3, a bending mold 5, a bending-back mold 6, and a controller 8.

Inner Core Metal

Figure 2A:
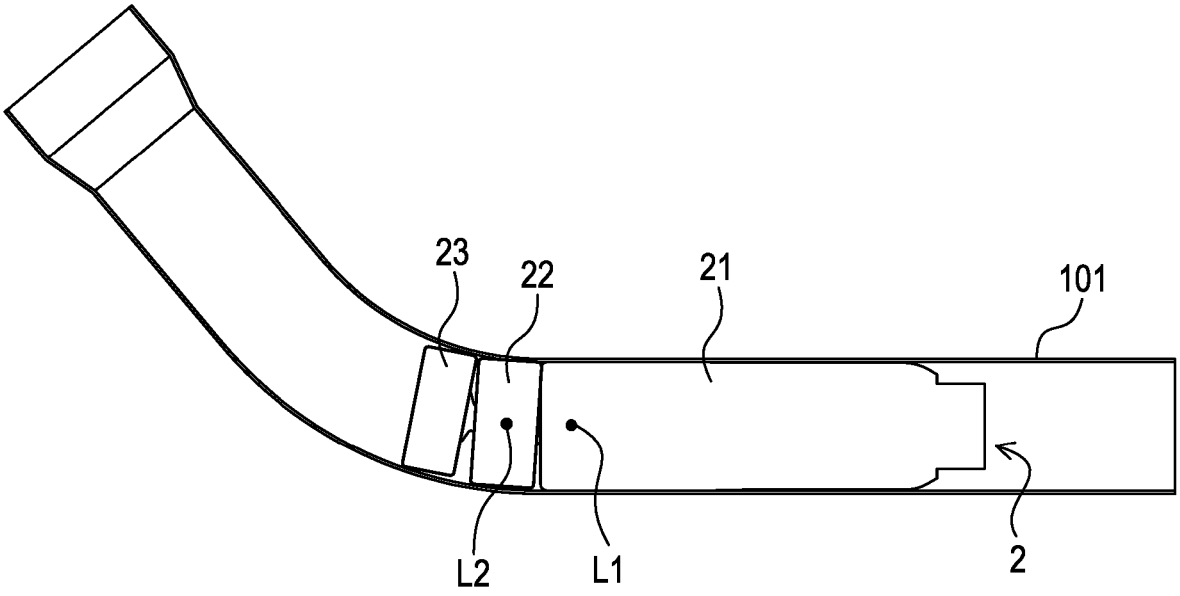
FIG. 2A is a schematic side view of an inner core metal in the manufacturing device for a bent pipe of FIG. 1.

As shown in FIG. 2A, the inner core metal 2 is configured to be placed inside the first pipe 101. The inner core metal 2 includes an inner core metal main body 21, a first inner movable portion 22, and a second inner movable portion 23.

Inner Core Metal Main Body

The inner core metal main body 21 comprises a cylindrical or columnar member. The inner core metal main body 21 is placed in a straight portion (in other words, a portion that is not bent) of the double pipe 110.

The outer diameter of the inner core metal main body 21 is constant along an axial direction thereof. The outer diameter of the inner core metal main body 21 is substantially equal to the inner diameter of the first pipe 101. A length of the inner core metal main body 21 along the axial direction is longer than respective lengths of the first inner movable portion 22 and the second inner movable portion 23 along the axial direction.

First Inner Movable Portion

The first inner movable portion 22 comprises a cylindrical or columnar member that is coupled to one end of the inner core metal main body 21 in the axial direction.

The first inner movable portion 22 pivots with respect to the inner core metal main body 21 about a first pivot axis L1 that is perpendicular to the central axis of the inner core metal main body 21. The first pivot axis L1 runs through an intersection between a straight line including the central axis of the inner core metal main body 21 and a straight line including the central axis of the first inner movable portion 22.

Second Inner Movable Portion

The second inner movable portion 23 comprises a cylindrical or columnar member that is coupled to the first inner movable portion 22 on the opposite side of the inner core metal main body 21 across the first inner movable portion 22.

The second inner movable portion 23 pivots with respect to the first inner movable portion 22 about a second pivot axis L2 that is parallel to the first pivot axis L1 of the first inner movable portion 22. The second pivot axis L2 runs through an intersection between the straight line including the central axis of the first inner movable portion 22 and a straight line including the central axis of the second inner movable portion 23.

Intermediate Core Metal

The intermediate core metal 3 shown in FIG. 1 is configured to be placed between the first pipe 101 and the second pipe 102.

The intermediate core metal 3 is placed in a bending portion of the double pipe 110 so as to interpose the first pipe 101 between the intermediate core metal 3 and the inner core metal 2 in a radial direction of the first pipe 101. Furthermore, the intermediate core metal 3 is interposed between the first pipe 101 and the second pipe 102 in a radial direction of the first pipe 101.

Figure 2B:
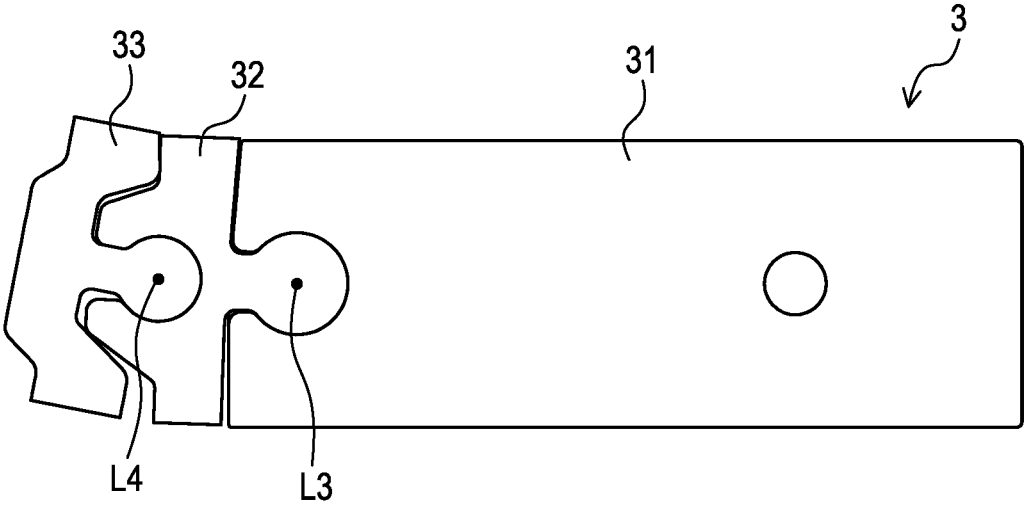
FIG. 2B is a schematic side view of an intermediate core metal in the manufacturing device for a bent pipe of FIG. 1.

As shown in FIG. 2B, the intermediate core metal 3 includes an intermediate core metal main body 31, a first intermediate movable portion 32, and a second intermediate movable portion 33.

Intermediate Core Metal Main Body

The intermediate core metal main body 31 comprises a cylindrical member. The intermediate core metal main body 31 is placed in the straight portion of the double pipe 110.

The inner diameter and the outer diameter of the intermediate core metal main body 31 are constant along an axial direction thereof. The inner diameter of the intermediate core metal main body 31 is substantially equal to the outer diameter of the first pipe 101. The outer diameter of the intermediate core metal main body 31 is substantially equal to the inner diameter of the second pipe 102. A length of the intermediate core metal main body 31 along the axial direction is longer than respective lengths of the first intermediate movable portion 32 and the second intermediate movable portion 33 along the axial direction.

First Intermediate Movable Portion

The first intermediate movable portion 32 comprises a cylindrical member that is directly coupled to one end of the intermediate core metal main body 31 in an axial direction.

The first intermediate movable portion 32 pivots with respect to the intermediate core metal main body 31 about a third pivot axis L3 that is perpendicular to the central axis of the intermediate core metal main body 31. The third pivot axis L3 runs through an intersection between a straight line including the central axis of the intermediate core metal main body 31 and a straight line including the central axis of the first intermediate movable portion 32. Furthermore, the third pivot axis L3 is parallel to the first pivot axis L1.

Second Intermediate Movable Portion

The second intermediate movable portion 33 comprises a cylindrical member that is directly coupled to the first intermediate movable portion 32 on the opposite side of the intermediate core metal main body 31 across the first intermediate movable portion 32.

The second intermediate movable portion 33 pivots with respect to the first intermediate movable portion 32 about a fourth pivot axis L4 that is parallel to the third pivot axis L3 of the first intermediate movable portion 32. The fourth pivot axis L4 runs through an intersection between the straight line including the central axis of the first intermediate movable portion 32 and a straight line including the central axis of the second intermediate movable portion 33.

Bending Mold

The bending mold 5 shown in FIG. 1 is configured to bend the double pipe 110 in an area of the double pipe 110 where the inner core metal 2 and the intermediate core metal 3 are placed.

Specifically, the bending mold 5 rotates and moves while interposing the first pipe 101 and the second pipe 102 between the bending mold 5, the inner core metal 2, and the intermediate core metal 3 in the radial direction, to thereby bend the first pipe 101 and the second pipe 102. The bending mold 5 includes a rotating portion 51, a first clamping portion 52, a slider 53, and a forwarding portion 54.

The rotating portion 51 is placed radially outside the bending portion of the double pipe 110. The rotating portion 51 is configured to rotate about a rotation axis P with a chuck portion 51A pressed against an outer-circumferential surface of the double pipe 110. The rotation axis P of the rotating portion 51 is parallel to the first pivot axis L1 of the first inner movable portion 22.

The rotating portion 51 is configured to press an inner surface of the first pipe 101 against the first inner movable portion 22 and the second inner movable portion 23, and also to press an inner surface of the second pipe 102 against the first intermediate movable portion 32 and the second intermediate movable portion 33.

The first clamping portion 52 is located opposite to the rotating portion 51 across the double pipe 110. The first clamping portion 52 is configured to hold the double pipe 110 between the first clamping portion 52 and the chuck portion 51A of the rotating portion 51. The first clamping portion 52 pivots about the rotation axis P of the rotating portion 51 as a result of rotation of the rotating portion 51.

The slider 53 is placed adjacent to the rotating portion 51. In the bending process, the slider 53 slides along an outer-circumference surface of the straight portion of the double pipe 110, to thereby exhibit a guiding function to forward the double pipe 110 along a rotation direction of the rotating portion 51.

The forwarding portion 54 is located at a position that is opposite to the slider 53 across the double pipe 110 and is adjacent to the first clamping portion 52. The forwarding portion 54 is configured to move along the central axis of the double pipe 110 while pressing the straight portion of the double pipe 110 in the radial direction. The forwarding portion 54 forwards the double pipe 110 toward the rotating portion 51 while pressing the double pipe 110 against the slider 53.

Bending-Back Mold

The bending-back mold 6 is configured to bend back the second pipe 102 of the double pipe 110, which has been bent by the bending mold 5. The bending-back mold 6 includes a second clamping portion 61, a third clamping portion 62, and a pressurizer 63.

The second clamping portion 61 and the third clamping portion 62 hold the double pipe 110 therebetween in the radial direction. Specifically, the third clamping portion 62 moves so as to press the double pipe 110 against the second clamping portion 61 fixed to the double pipe 110, thereby fixing the double pipe 110 between the second clamping portion 61 and the third clamping portion 62.

The pressurizer 63 presses itself against the outer-circumferential surface of the double pipe 110 to externally apply pressure to the double pipe 110 in the radial direction. As a result, the second pipe 102 of the double pipe 110 is bent in a manner to rotate about the fulcrum.

Controller

The controller 8 is configured with, for example, a microcomputer that comprises a microprocessor, a storage medium, such as a RAM, a ROM, or the like, an inputter, and an outputter. The controller 8 executes a program stored in advance, to thereby control respective operations of the bending mold 5 and the bending-back mold 6.

The controller 8 is configured to execute a first bending process, a second bending process, a first bending-back process, and a second bending-back process. In a method of manufacturing a bent pipe described below, first bending corresponds to the first bending process; second bending corresponds to the second bending process; first bending-back corresponds to the first bending-back process; and second bending-back corresponds to the second bending-back process.

1-2. Manufacturing Method

Figure 3:
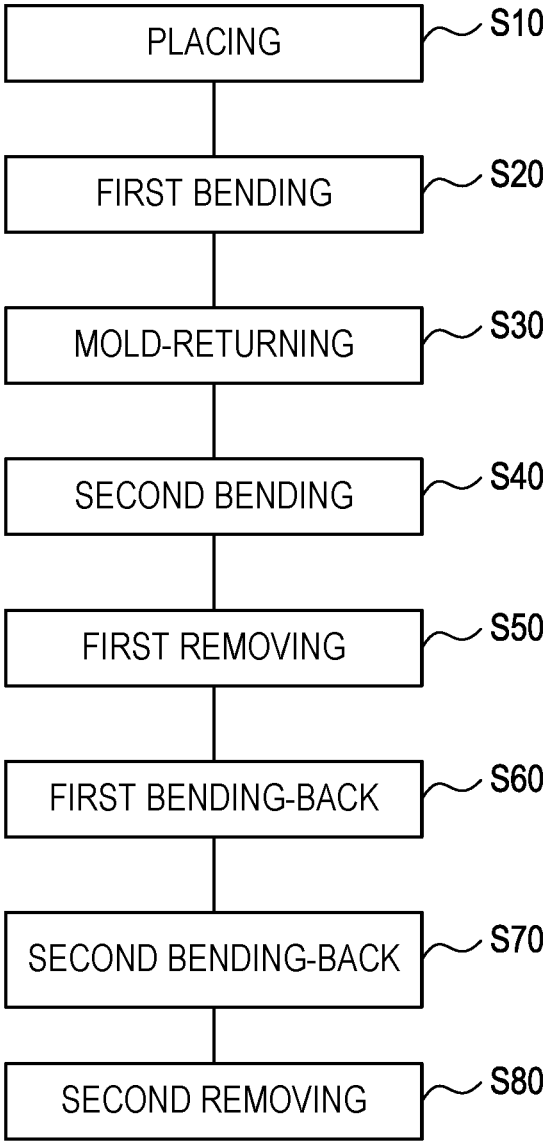
FIG. 3 is a flow chart of a method of manufacturing a bent pipe according to the embodiment.

Hereinafter, descriptions are given to a method of manufacturing a bent pipe using the manufacturing device 1 for a bent pipe shown in FIG. 1. As shown in FIG. 3, the method of manufacturing a bent pipe according to the present embodiment comprises placing S10, first bending S20, mold-returning S30, second bending S40, first removing S50, first bending-back S60, second bending-back S70, and second removing S80.

Placing

In the placing, the inner core metal 2 is placed inside the first pipe 101 and the intermediate core metal 3 is placed between the first pipe 101 and the second pipe 102. Specifically, the double pipe 110 is introduced in the axial direction toward the inner core metal 2 and the intermediate core metal 3 that are held between the rotating portion 51 and the first clamping portion 52 of the bending mold 5.

In this placing, the inner core metal 2 is held such that the respective central axes of the inner core metal main body 21, the first inner movable portion 22, and the second inner movable portion 23 coincide with each other. Similarly, the intermediate core metal 3 is held such that the respective central axes of the intermediate core metal main body 31, the first intermediate movable portion 32, and the second intermediate movable portion 33 coincide with each other.

Furthermore, the first inner movable portion 22 is placed such that at least a portion thereof overlaps with the intermediate core metal 3 in the radial direction of the first pipe 101. The second inner movable portion 23 is placed not to overlap with the intermediate core metal 3 in the radial direction of the first pipe 101.

First Bending

In this first bending, the first pipe 101 and the second pipe 102 are bent by the bending mold 5 in a first direction D1 in a first area R1 of the double pipe 110 where the inner core metal 2 and the intermediate core metal 3 are placed.

Figure 4A:
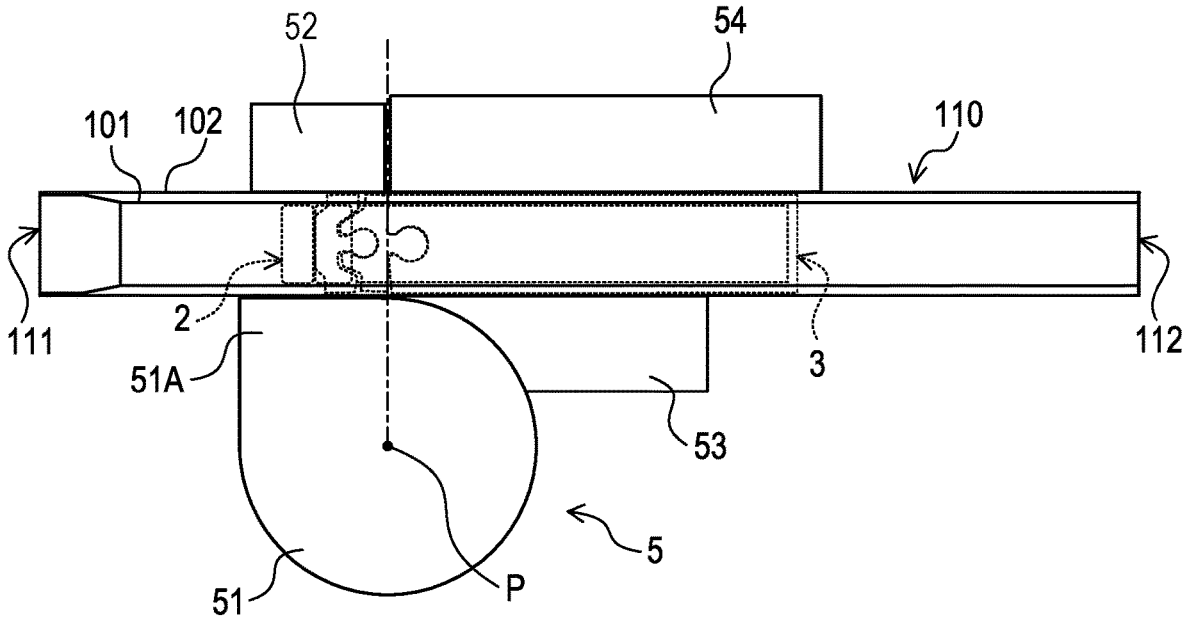
FIG. 4A is a schematic diagram explaining a process of the method of manufacturing a bent pipe of FIG. 3.

Specifically, as shown in FIG. 4A, the first clamping portion 52 and the forwarding portion 54 apply pressure, in the radial direction, to the double pipe 110 that contains the inner core metal 2 and the intermediate core metal 3 therein. As a result, the double pipe 110 slides toward the rotating portion 51 in the radial direction together with the inner core metal 2 and the intermediate core metal 3. The double pipe 110 is pressed against the chuck portion 51A of the rotating portion 51 by the first clamping portion 52 and is also pressed against the slider 53 by the forwarding portion 54.

Figure 4B:
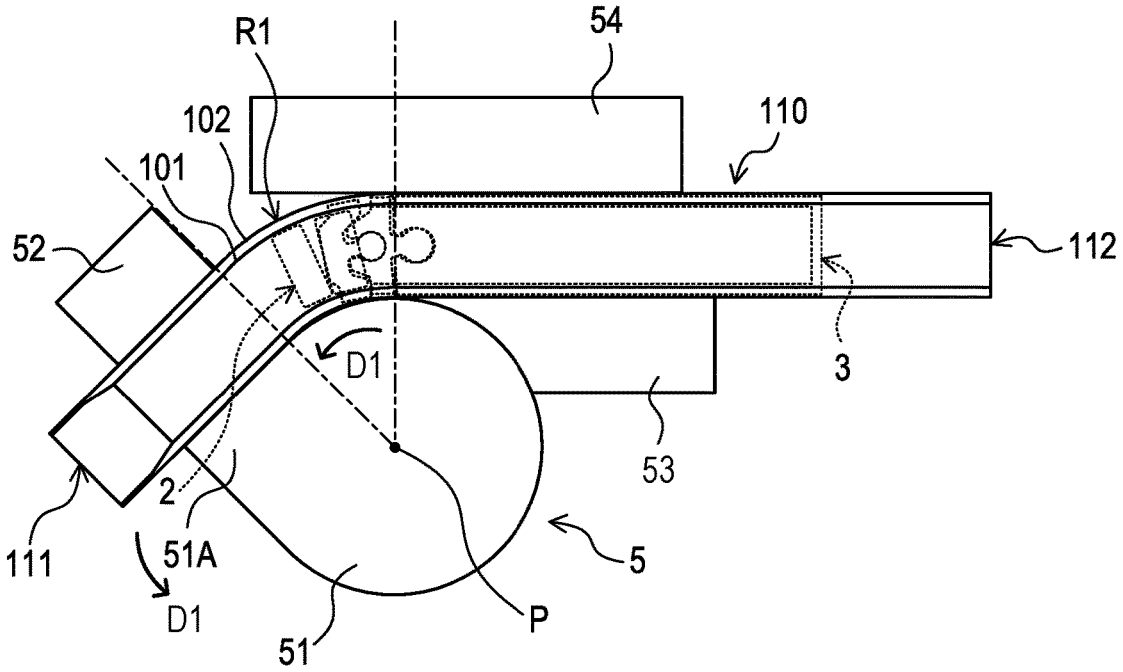
FIG. 4B is a schematic diagram explaining a process subsequent to the process of FIG. 4A.

Subsequently, as shown in FIG. 4B, the rotating portion 51 rotates in a direction in which the chuck portion 51A is spaced apart from the slider 53 (that is, toward the first end 111) and the forwarding portion 54 slides in a direction to follow the first clamping portion 52. The rotation direction of the rotating portion 51 coincides with the first direction D1.

Due to the above-described rotation and sliding, the chuck portion 51A and the first clamping portion 52 slide on the outer-circumferential surface of the double pipe 110 toward the first end 111 while interposing the double pipe 110 therebetween. Consequently, a portion of the double pipe 110, which is interposed between the chuck portion 51A and the first clamping portion 52, is plastically deformed to curve about the rotation axis P1 of the rotating portion 51.

The first inner movable portion 22 pivots with respect to the inner core metal main body 21 to correspond to the bending of the double pipe 110 resulting from the rotation of the rotating portion 51. Similarly, the second inner movable portion 23 pivots with respect to the first inner movable portion 22 to correspond to the bending of the double pipe 110 resulting from the rotation of the rotating portion 51.

The inner core metal main body 21 and the intermediate core metal main body 31 are held not to move during the bending. Accordingly, the double pipe 110 moves, extending in a movement direction of the first clamping portion 52, while sliding with respect to the inner core metal 2 and the intermediate core metal 3.

In the first bending, the double pipe 110 is bent at an increased bending angle greater than a designed bending angle in the first area R1 of the bent pipe to be manufactured (in other words, a bending angle in the first area R1 of the double pipe 110 that has undergone all the actions in the manufacturing method) to be ready for being bent back.

The increased bending angle can be determined by actually measuring the gap between the first pipe 101 and the second pipe 102 after the bending. The increased bending angle is, for example, 2° or larger and 5° or smaller.

Mold-Returning

In this mold-returning, the inner core metal 2, the intermediate core metal 3, and the bending mold 5 return to respective initial positions after the first bending S20.

Figure 5A:
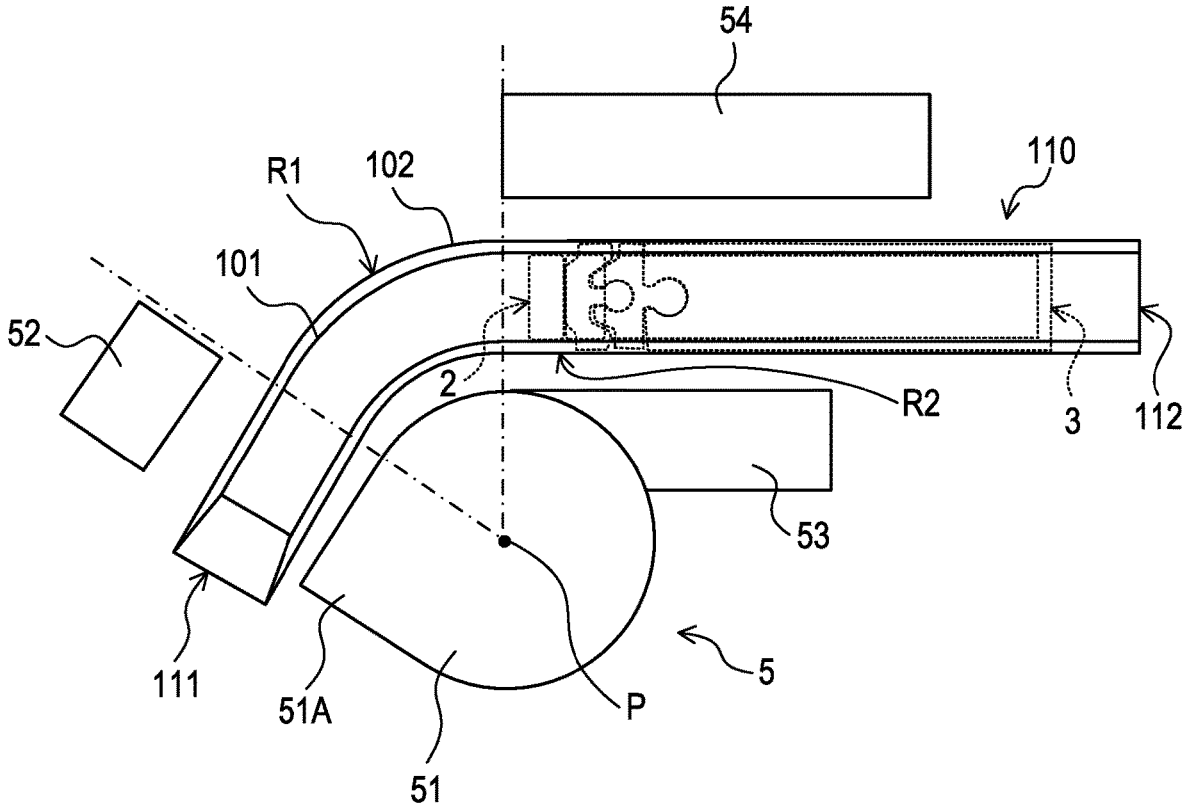
FIG. 5A is a schematic diagram explaining a process subsequent to the process of FIG. 4B.

First of all, as shown in FIG. 5A, the inner core metal 2 and the intermediate core metal 3 return back to respective positions that overlap with a second area R2, which is different from the first area R1. The second area R2 is located closer to the second end 112 than the first area R1 is.

Furthermore, the first clamping portion 52 and the forwarding portion 54 are spaced apart from the double pipe 110 in the radial direction and the double pipe 110 is spaced apart from the rotating portion 51 and also the slider 53. Also, the forwarding portion 54 returns to its initial position.

Figure 5B:
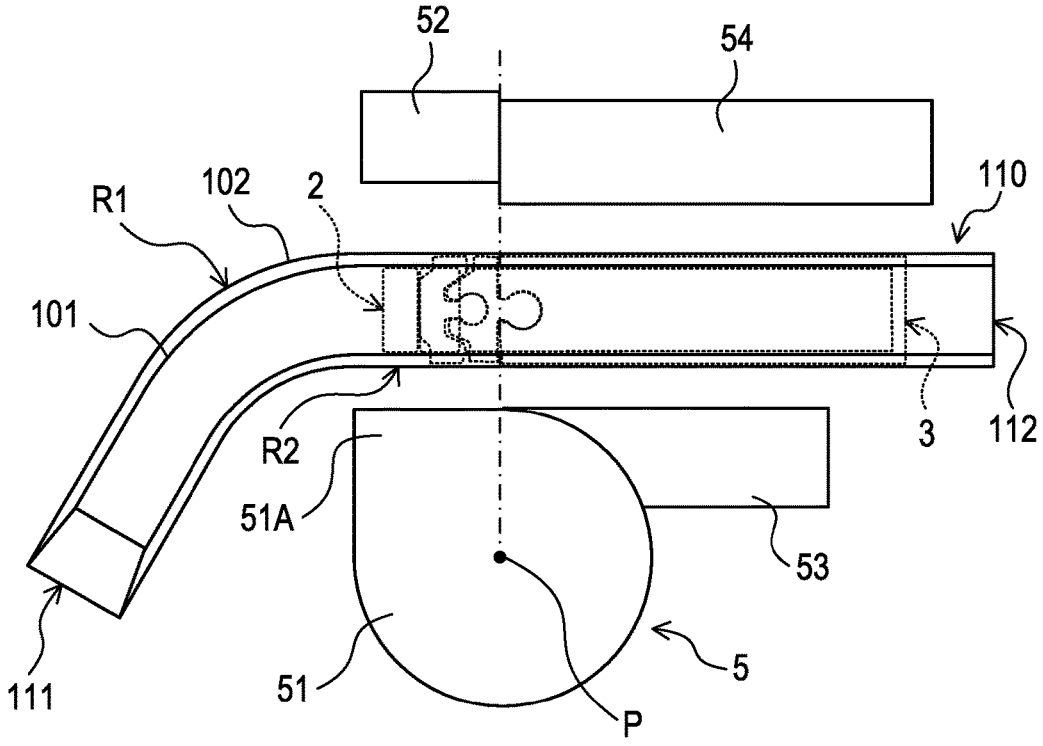
FIG. 5B is a schematic diagram explaining a process subsequent to the process of FIG. 5A.

Subsequently, as shown in FIG. 5B, after the rotating portion 51 and the first clamping portion 52 return to respective initial positions, the double pipe 110 is slid in the axial direction together with the inner core metal 2 and the intermediate core metal 3 to a position where the second area R2 of the double pipe 110 overlaps with the first clamping portion 52 in the radial direction.

Second Bending

In this second bending, after the first bending S20 and the mold-returning S30, the bending mold 5 bends the first pipe 101 and the second pipe 102 in a second direction D2 in the second area R2 of the double pipe 110 where the inner core metal 2 and the intermediate core metal 3 are placed.

Figure 6A:
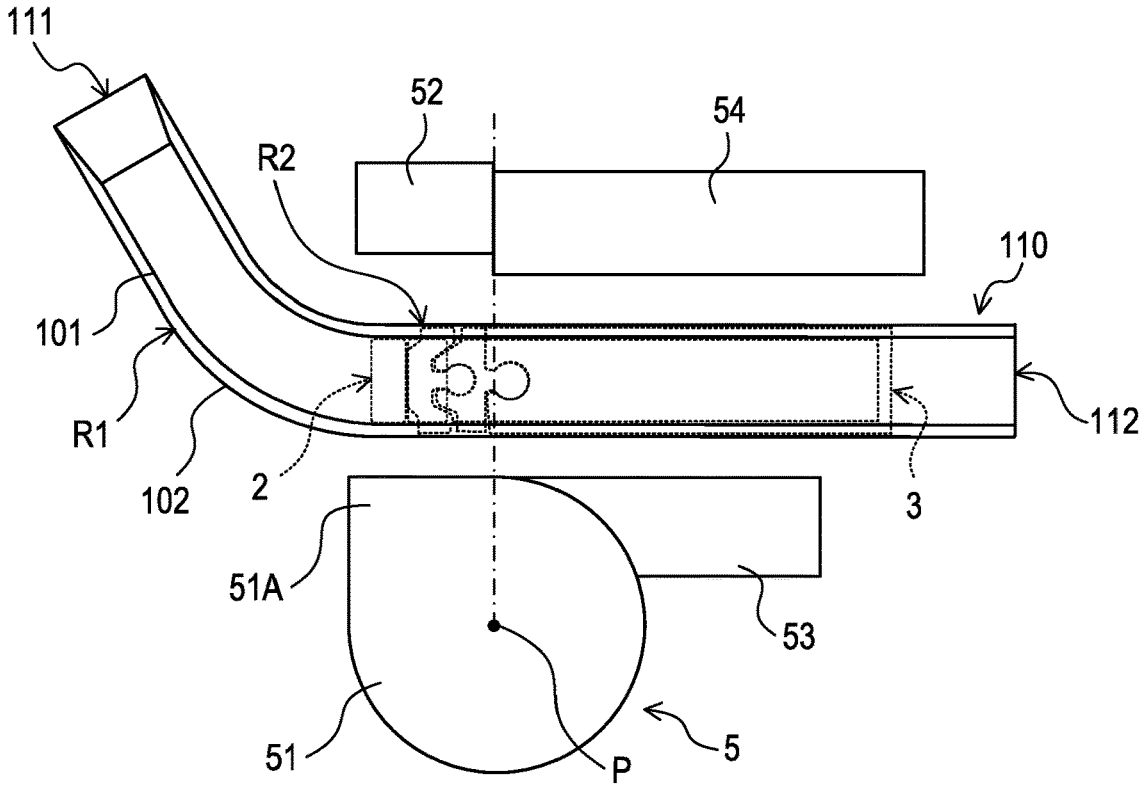
FIG. 6A is a schematic diagram explaining a process subsequent to the process of FIG. 5B.

Specifically, as shown in FIG. 6A, the double pipe 110 is first rotated about the central axis at the second end 112 such that a bending direction in the second area R2 (that is, the second direction D2) and the rotation direction of the rotating portion 51 coincide with each other.

Figure 6B:
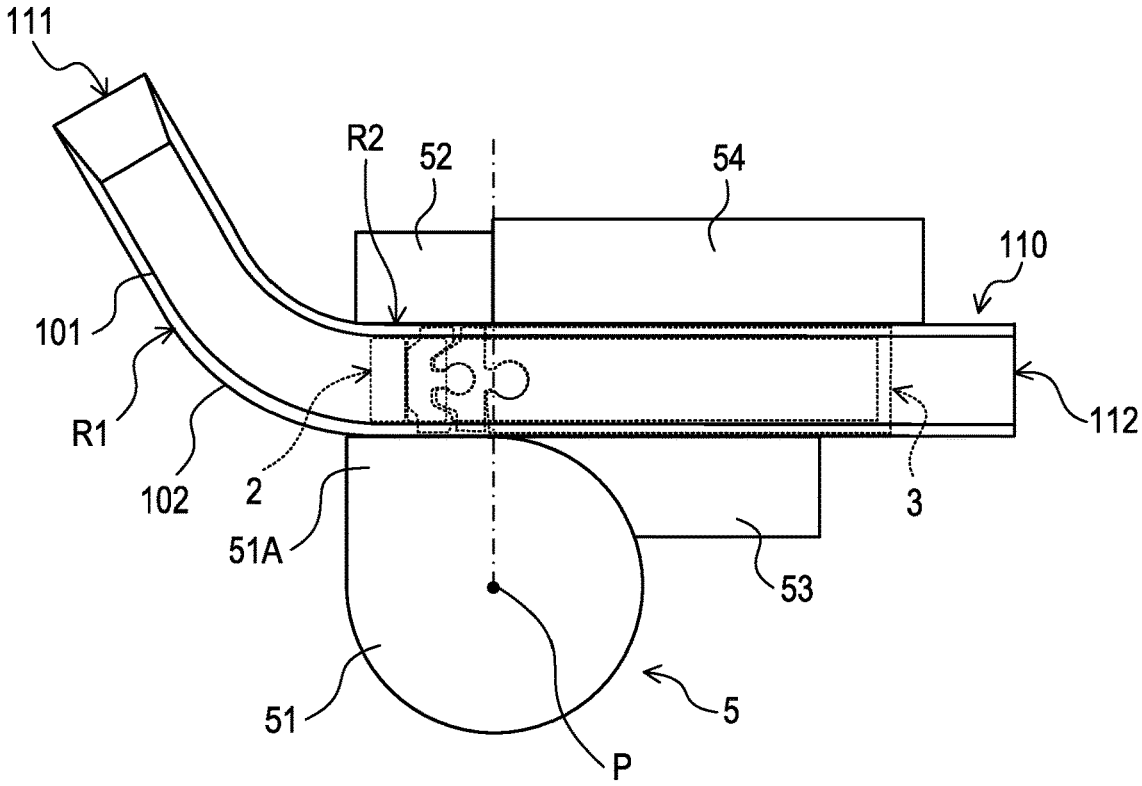
FIG. 6B is a schematic diagram explaining a process subsequent to the process of FIG. 6A.

Subsequently, as shown in FIG. 6B, the first clamping portion 52 and the forwarding portion 54 apply pressure, in the radial direction, to the double pipe 110 that contains the inner core metal 2 and the intermediate core metal 3 therein. The double pipe 110 is pressed against the chuck portion 51A of the rotating portion 51 by the first clamping portion 52 and is also pressed against the slider 53 by the forwarding portion 54.

Figure 7A:
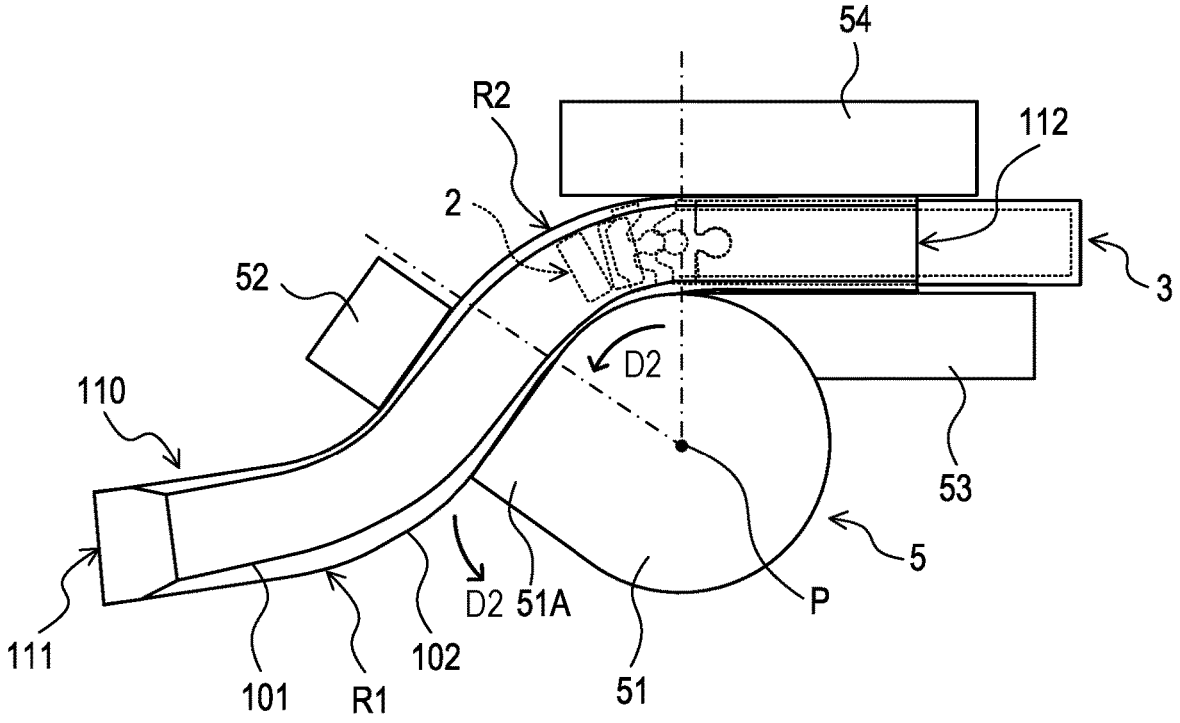
FIG. 7A is a schematic diagram explaining a process subsequent to the process of FIG. 6B.

Subsequently, as shown in FIG. 7A, the rotating portion 51 rotates in a direction in which the chuck portion 51A is spaced apart from the slider 53 (that is, toward the first end 111) and the forwarding portion 54 slides in a direction to follow the first clamping portion 52. The rotation direction of the rotating portion 51 coincides with the second direction D2.

Consequently, a portion of the double pipe 110, which is interposed between the chuck portion 51A and the first clamping portion 52, is plastically deformed to curve about the rotation axis P of the rotating portion 51. During this deformation, the first pipe 101 is pulled and extends in the axial direction in the first area R1 as a result of the bending in the second area R2. This extension of the first pipe 101 causes the first pipe 101 to be bent back in the first area R1. As a result, the gap between the first pipe 101 and the second pipe 102 is reduced in the first area R1.

In the second bending, the double pipe 110 is bent at an increased bending angle greater than a designed bending angle in the second area R2 of the bent pipe to be manufactured (in other words, a bending angle in the second area R2 of the double pipe 110 that has undergone all the actions in the manufacturing method) to be ready for being bent back.

First Removing

In this first removing, the double pipe 110 is removed from the inner core metal 2, the intermediate core metal 3, and the bending mold 5 after the bending.

Figure 7B:
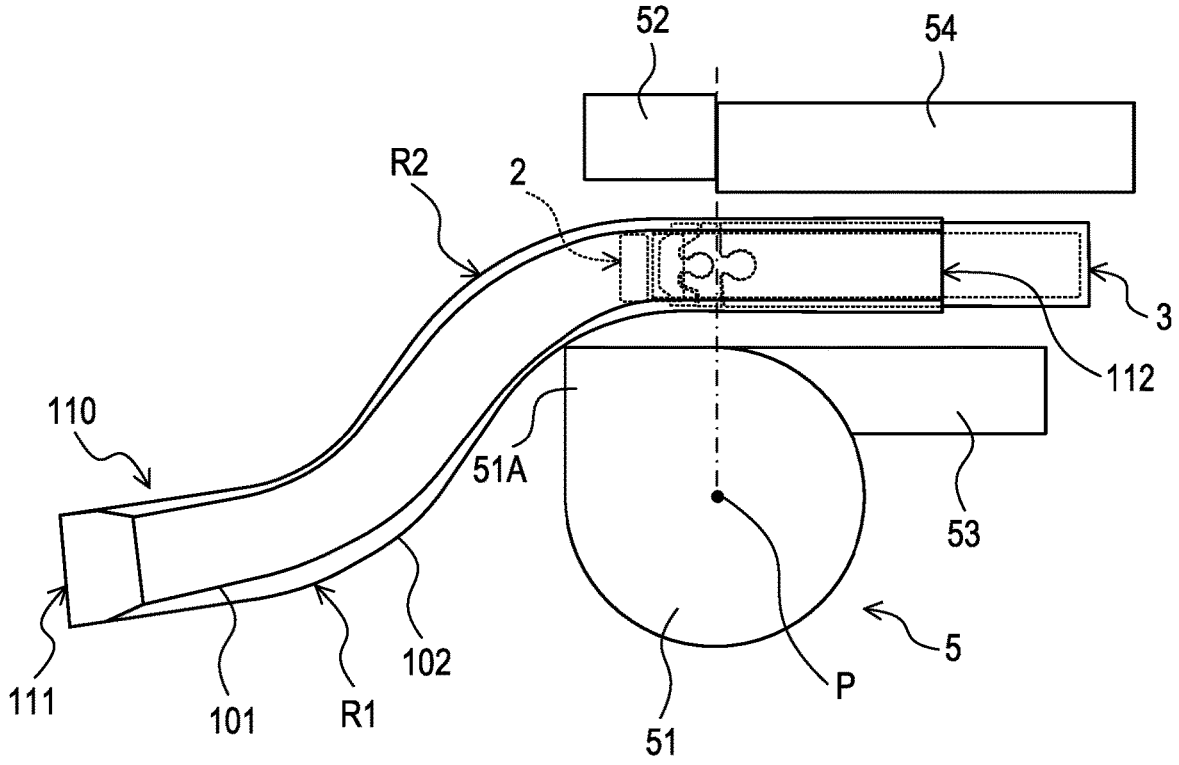
FIG. 7B is a schematic diagram explaining a process subsequent to the process of FIG. 7A.

Specifically, as shown in FIG. 7B, the inner core metal 2 and the intermediate core metal 3 first return back to respective positions that do not overlap with the second area R2 of the double pipe 110. During this, the first pipe 101 is pulled by the inner core metal 2 and the intermediate core metal 3 and extends in the axial direction in the second area R2. This extension of the first pipe 101 causes the first pipe 101 to be bent back in the second area R2. As a result, the gap between the first pipe 101 and the second pipe 102 is reduced in the second area R2.

After the inner core metal 2 and the intermediate core metal 3 return back to the above-described positions, the first clamping portion 52 and the forwarding portion 54 are spaced apart from the double pipe 110 in the radial direction and the double pipe 110 is spaced apart from the rotating portion 51 and also the slider 53. Furthermore, the bending mold 5 returns to the initial position (that is, a position allowing the double pipe 110 to be introduced before the bending). Then, the double pipe 110 is removed from the inner core metal 2, intermediate core metal 3, and the bending mold 5.

First Bending-Back

In this first bending-back, the second pipe 102 is bent in a third direction D3 in the first area R1 after the first bending S20 and the second bending S40. The third direction D3 is the opposite direction of the first direction D1.

Figure 8A:
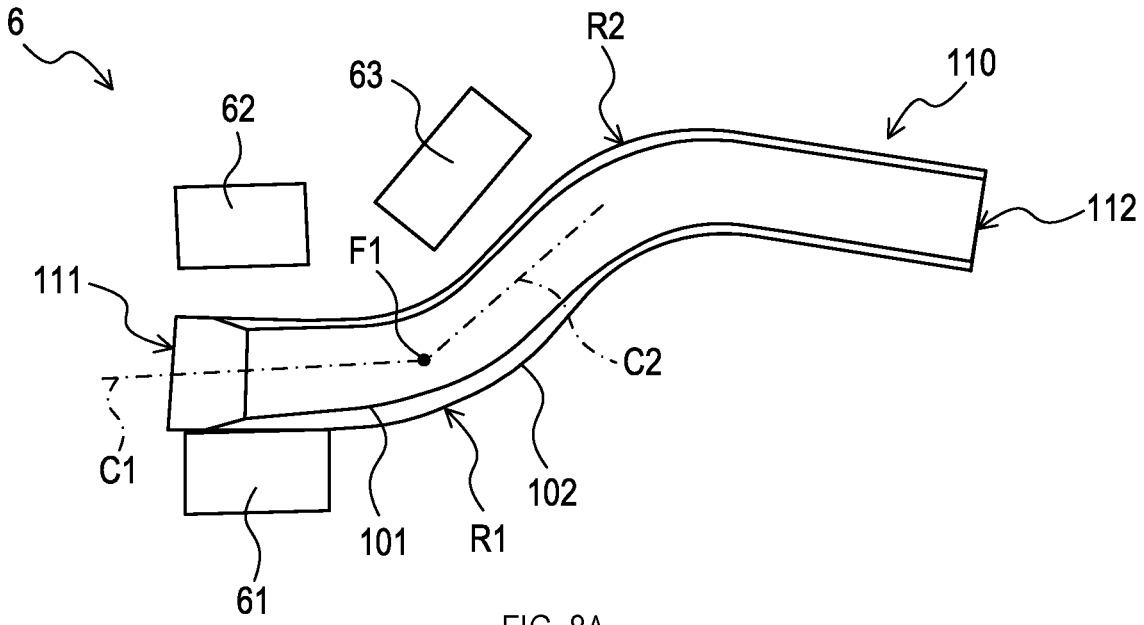
FIG. 8A is a schematic diagram explaining a process subsequent to the process of FIG. 7B.

Specifically, as shown in FIG. 8A, the double pipe 110, which has been removed from the bending mold 5 in the first removing S50, is first placed between the second clamping portion 61 and the third clamping portion 62 of the bending-back mold 6.

Figure 8B:
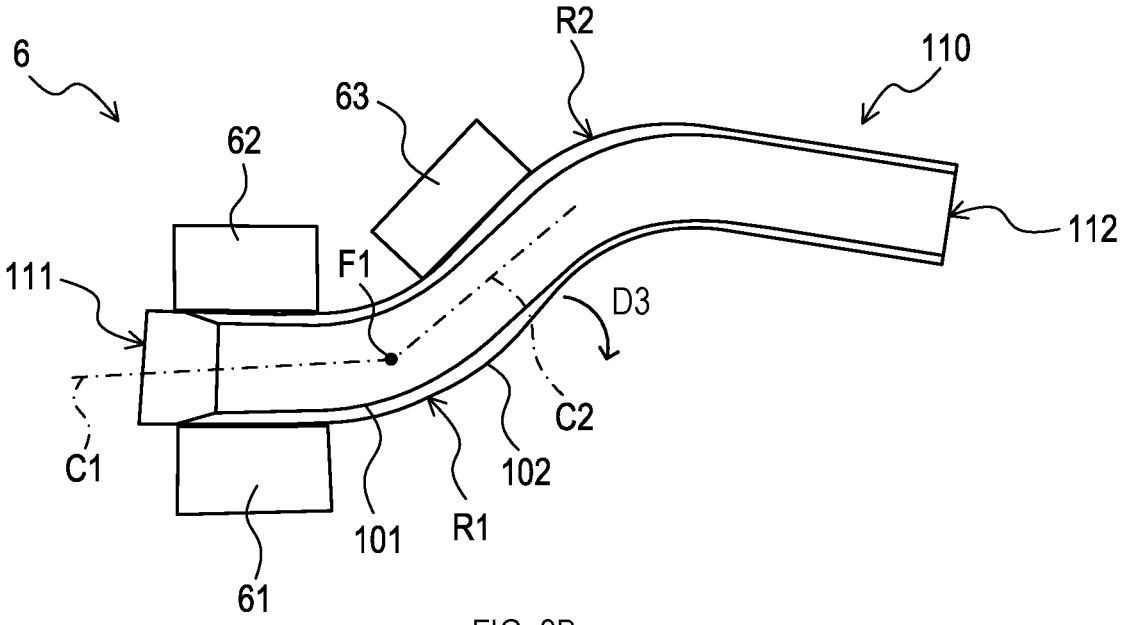
FIG. 8B is a schematic diagram explaining a process subsequent to the process of FIG. 8A.

Subsequently, as shown in FIG. 8B, the third clamping portion 62 moves toward the second clamping portion 61, to thereby hold, in the radial direction, a portion of the double pipe 110 located closer to the first end 111 than the first area R1 is. With the double pipe 110 held between the third clamping portion 62 and the second clamping portion 61, the pressurizer 63 presses itself against a portion of the double pipe 110 located between the first area R1 and the second area R2 in the radial direction.

As a result, the second pipe 102 rotates about the center of the first area R1 as the fulcrum F1, thereby being bent in the third direction D3. The fulcrum F1 is an intersection between a central axis C1 and a central axis C2. The central axis C1 is an axis of a portion of the second pipe 102 that is located closer to the first end 111 than the first area R1 is. The central axis C2 is an axis of a portion of the second pipe 102 that is located between the first area R1 and the second area R2.

In the first bending back, the first pipe 101 is not bent. Furthermore, the second pipe 102 is bent back at a bending-back angle that substantially equalizes the bending angle of the first pipe 101 and the bending angle of the second pipe 102 to each other in the first area R1 (in other words, the gap between the first pipe 101 and the second pipe 102 at the inner side of the bent portion and the gap between the first pipe 101 and the second pipe 102 at the outer side of the bent portion are substantially equal to each other).

Second Bending-Back

In this second bending back, the second pipe 102 is bent in a fourth direction D4 in the second area R2 after the first bending-back S60. The fourth direction D4 is the opposite direction of the second direction D2. The second bending-back S70 may be performed before the first bending-back S60.

Figure 9A:
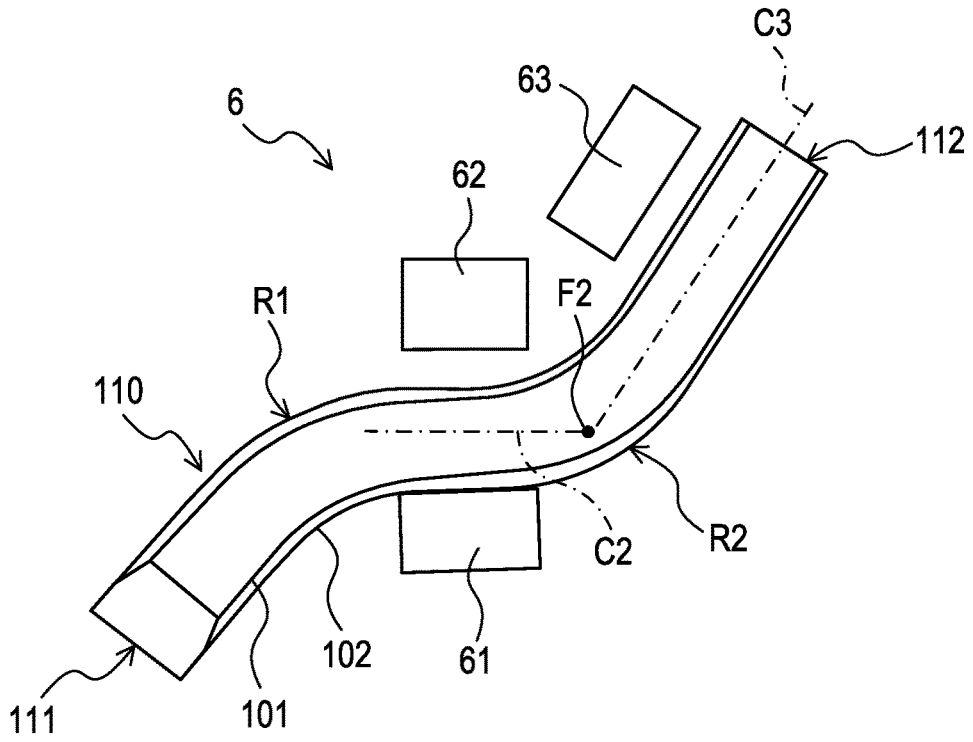
FIG. 9A is a schematic diagram explaining a process subsequent to the process of FIG. 8B.

Specifically, as shown in FIG. 9A, the double pipe 110, which has been bent back in the first area R1, is first changed in orientation and re-placed between the second clamping portion 61 and the third clamping portion 62 of the bending-back mold 6.

Figure 9B:
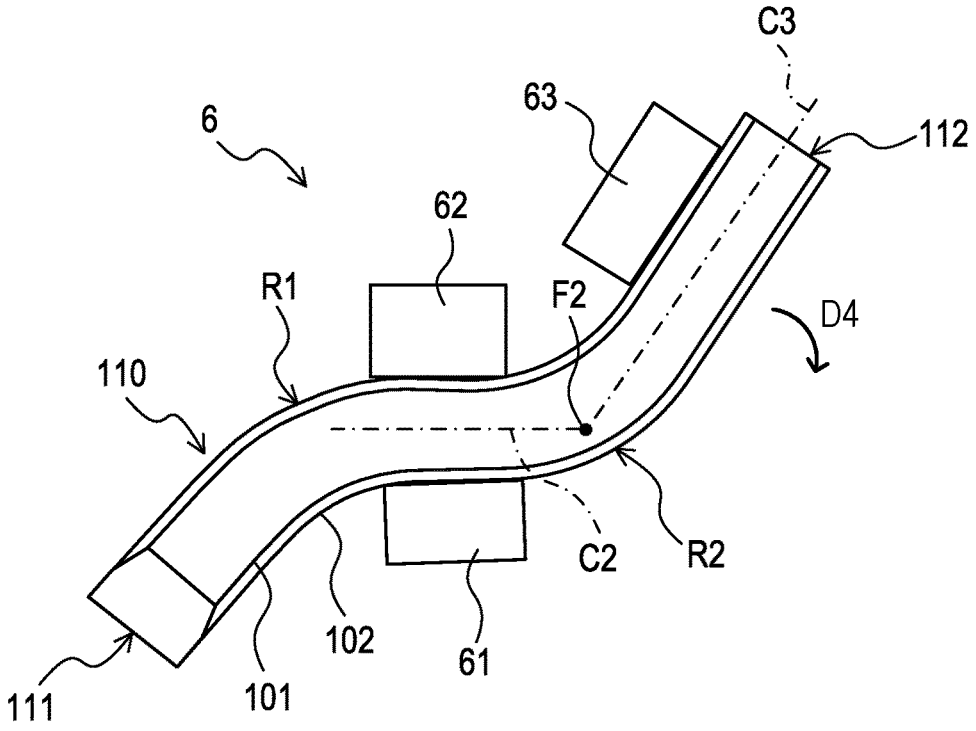
FIG. 9B is a schematic diagram explaining a process subsequent to the process of FIG. 9A.

Subsequently, as shown in FIG. 9B, the third clamping portion 62 moves toward the second clamping portion 61, to thereby hold, in the radial direction, the portion of the double pipe 110 located between the first area R1 and the second area R2. With the double pipe 110 held between the third clamping portion 62 and the second clamping portion 61, the pressurizer 63 presses itself, in the radial direction, against a portion of the double pipe 110 located closer to the second end 112 than the second area R2 is.

As a result, the second pipe 102 rotates about the center of the second area R2 as the fulcrum F2, thereby being bent in the fourth direction D4. The fulcrum F2 is an intersection between the central axis C2 and a central axis C3. The central axis C2 is the axis of the portion of the second pipe 102 that is located between the first area R1 and the second area R2. The central axis C3 is an axis of a portion of the second pipe 102 that is located closer to the second end 112 than the second area R2 is.

In the second bending back, the first pipe 101 is not bent. Furthermore, the second pipe 102 is bent back at a bending-back angle that substantially equalizes the bending angle of the first pipe 101 and the bending angle of the second pipe 102 to each other in the second area R2.

Second Removing

In this second removing, the double pipe 110 is removed from the bending-back mold 6 after the first bending-back S60 and the second bending-back S70.

1-3. Effects

The embodiment detailed above can bring the following effects.

(1a) The gap between the first pipe 101 and the second pipe 102 is reduced in the first area R1 during the second bending process. This reduction of the gap can be compensated by the bending-back processes in which the second pipe 102 is bent in the opposite direction to the bending direction. Thus, the double pipe 110 can be bent multiple times with the gap between the first pipe 101 and the second pipe 102 maintained.

(1b) The bending-back processes leave the gap between the first pipe 101 and the second pipe 102 and therefore, it is not necessary to adjust the gap by pressing an end surface of the first pipe 101 in the axial direction. Consequently, wrinkling (that is, buckling) caused by pressing the end surface of the first pipe 101, which is performed for adjusting the gap, does not occur.

(1c) The second bending-back process can also compensate for reduction of the gap between the first pipe 101 and the second pipe 102 that occurs in the second area R2 when the double pipe 110 is removed from the inner core metal 2 and the intermediate core metal 3.

(1d) The first bending-back process and the second bending-back process are performed after the second bending process. This enables the double pipe 110 to be bent back while being placed in a specified orientation after the first bending process and the second bending process are completed. Thus, the gap between the first pipe 101 and the second pipe 102 can be easily compensated.

(1e) In the first bending-back process and the second bending-back process, the second pipe 102 rotates about the center of the first area R1 or the second area R2 as the fulcrum. As a result, the second pipe 102 is bent back in the area in which the first pipe 101 is deformed greatly and therefore, the gap between the first pipe 101 and the second pipe 102 can be more precisely left.

2. Second Embodiment 2-1. Configuration

Figure 10:
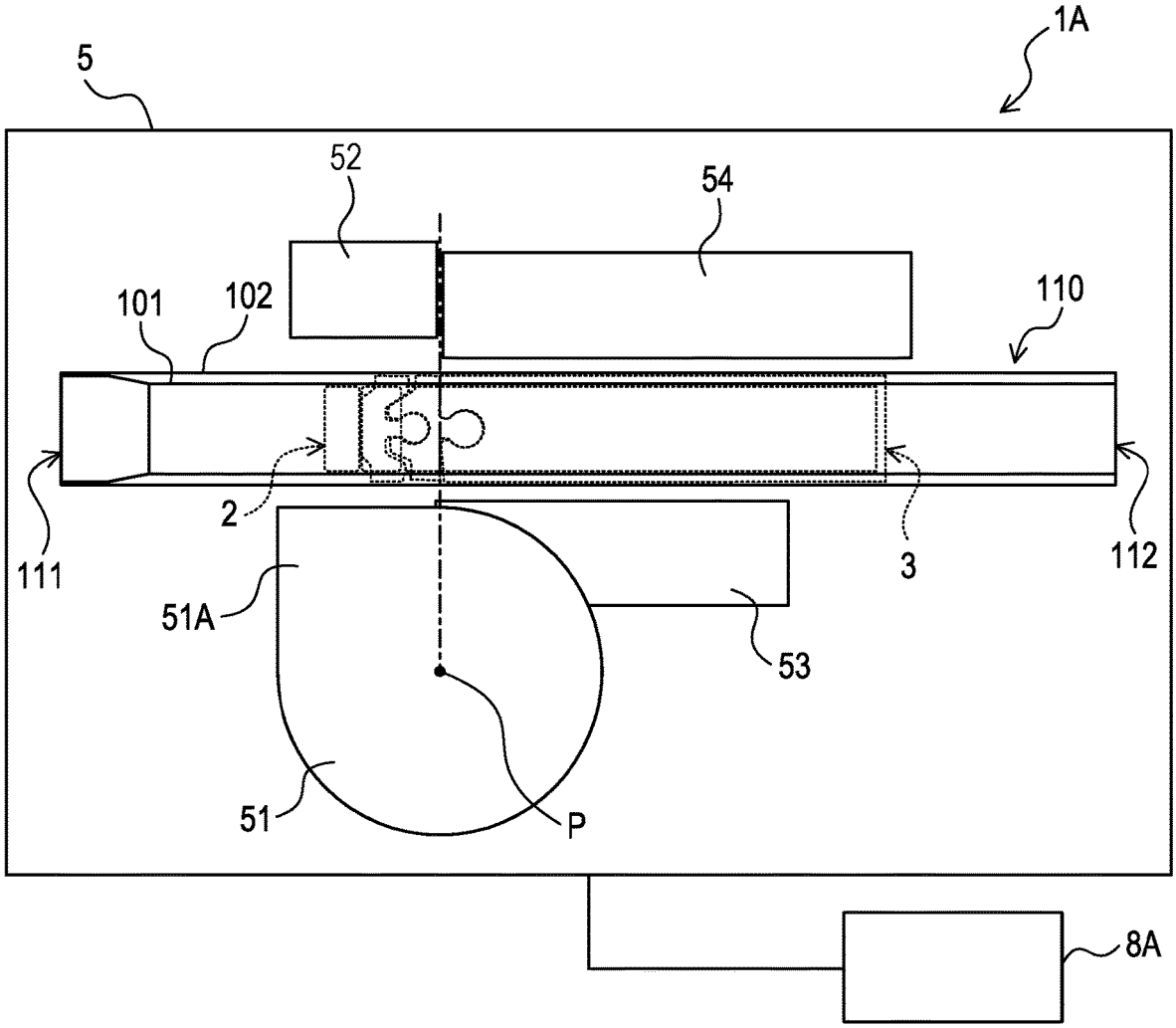
FIG. 10 is a schematic diagram of a manufacturing device for a bent pipe according to an embodiment different from the embodiment of FIG. 1.

A manufacturing device 1A of a bent pipe (hereinafter, simply referred to as "manufacturing device 1A" as well) shown in FIG. 10 is a device for obtaining a bent pipe by bending a straight pipe.

The manufacturing device 1A of the present embodiment comprises the inner core metal 2, the intermediate core metal 3, the bending mold 5, and a controller 8A. The inner core metal 2, the intermediate core metal 3, and the bending mold 5 in the manufacturing device 1A are identical with the inner core metal 2, intermediate core metal 3, and the bending mold 5 in the manufacturing device 1 of FIG. 1.

Controller

The controller 8A is configured with, for example, a microcomputer that comprises a microprocessor, a memory medium, such as a RAM, a ROM, or the like, an inputter, and an outputter. The controller 8A executes a program stored in advance, to thereby control the operation of the bending mold 5.

The controller 8A is configured to execute a first bending process, a second bending process, a first bending-back process, and a second bending-back process. In the present embodiment, the controller 8A executes the first bending-back process and the second bending-back process using the bending mold 5.

2-2. Manufacturing Method

Figure 11:
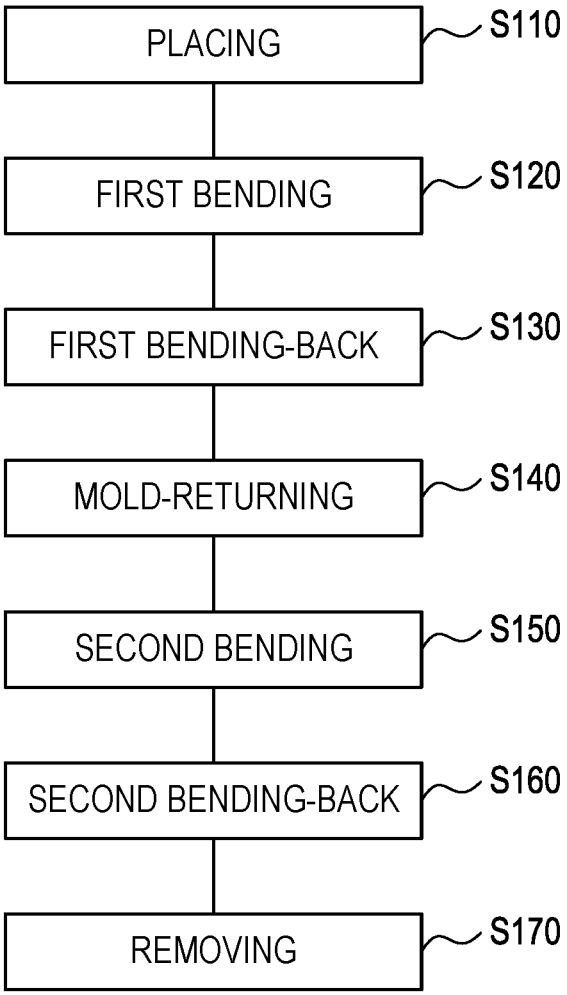
FIG. 11 is a flow chart of a method of manufacturing a bent pipe according to an embodiment different from the embodiment of FIG. 3.

Hereinafter, descriptions are given to a method of manufacturing a bent pipe using the manufacturing device 1A for a bent pipe of FIG. 10. As shown in FIG. 11, the method of manufacturing a bent pipe of the present embodiment comprises placing S110, first bending S120, first bending-back S130, mold-returning S140, second bending S150, second bending-back S160, and removing S170.

Placing

This placing is identical with the placing S10 in the method of manufacturing a bent pipe of FIG. 3. Thus, description will be omitted.

First Bending

The first bending is identical with the first bending S20 in the method of manufacturing a bent pipe of FIG. 3. Thus, description will be omitted (see, FIGS. 4A and 4B).

First Bending-Back

In this first bending-back, the second pipe 102 is bent in the first area R1 in the third direction D3, which is opposite to the first direction D1, after the first bending S120, but before the second bending S150.

Figure 12A:
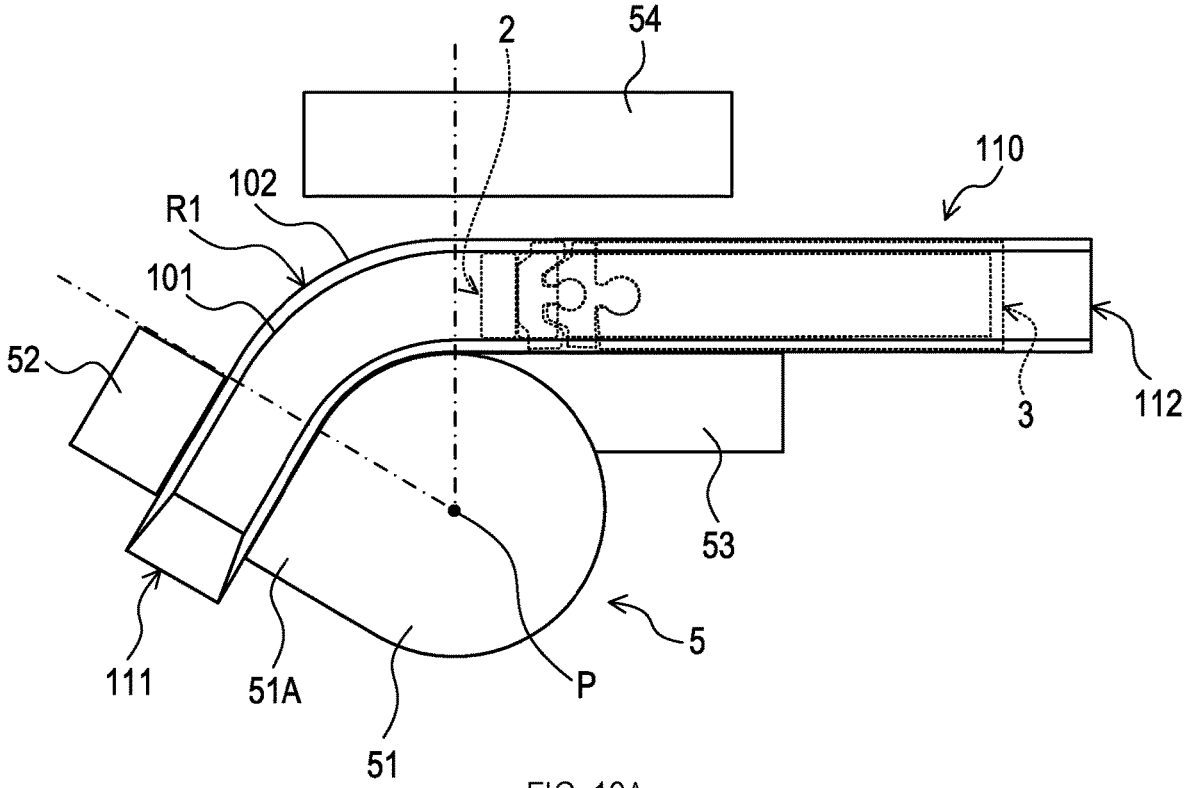
FIG. 12A is a schematic diagram explaining a process of the method of manufacturing a bent pipe of FIG. 11.
Figure 12B:
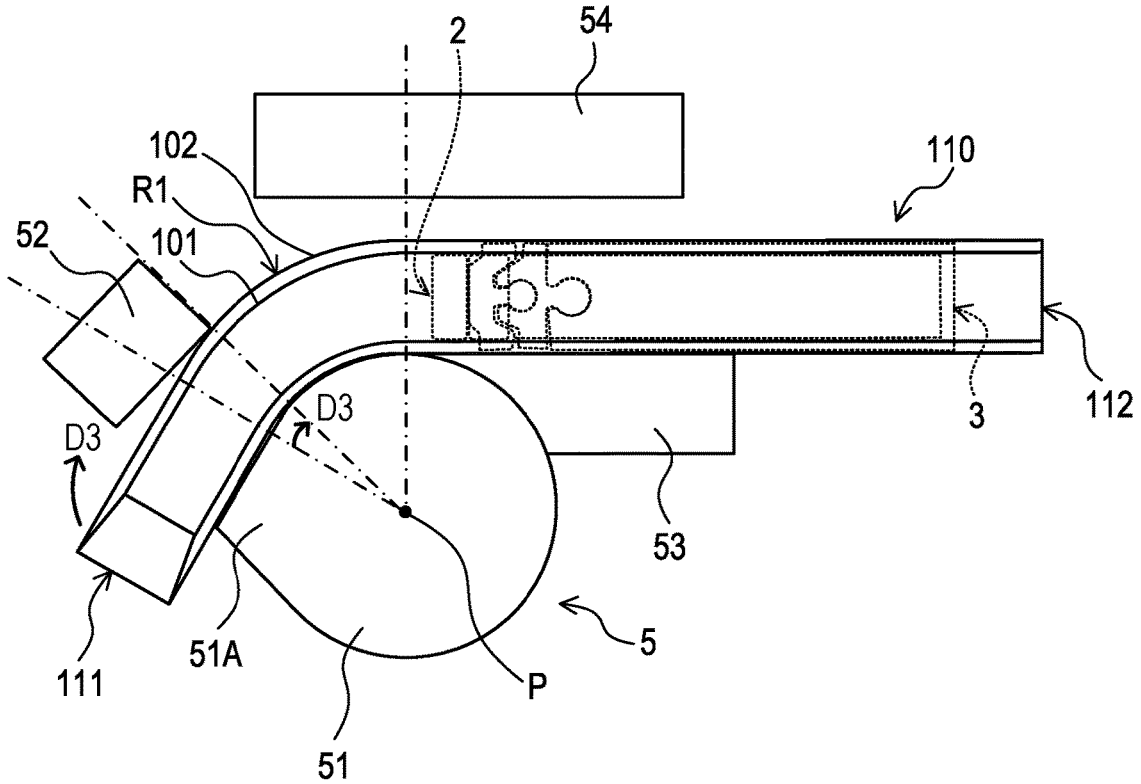
FIG. 12B is a schematic diagram explaining a process subsequent to the process of FIG. 12A.

Specifically, as shown in FIG. 12A, the inner core metal 2 and the intermediate core metal 3 first return back to respective positions that do not overlap with the first area R1. Then, as shown in FIG. 12B, the rotating portion 51 rotates in the third direction D3 with the chuck portion 51A and the first clamping portion 52 interposing therebetween a portion of the double pipe 110 located closer to the first end 111 than the first area R1 is. During this rotation, the inner core metal 2 and the intermediate core metal 3 are not placed in the first area R1 and therefore, only the second pipe 102 is bent in the third direction D3.

In this way, in the present embodiment, the second pipe 102 is bent to have a smaller bending angle than the bending angle of the first pipe 101 in advance to be ready for deformation of the first pipe 101 in the first area R1, which occurs due to the second bending S150.

The second pipe 102 is bent back at a bending-back angle that substantially equalizes the bending angle of the first pipe 101 and the bending angle of the second pipe 102 to each other in the first area R1 after the second bending S150.

Mold-Returning

In this mold-returning, the inner core metal 2, the intermediate core metal 3, and the bending mold 5 return to respective initial positions after the first bending-back S130.

Figure 13A:
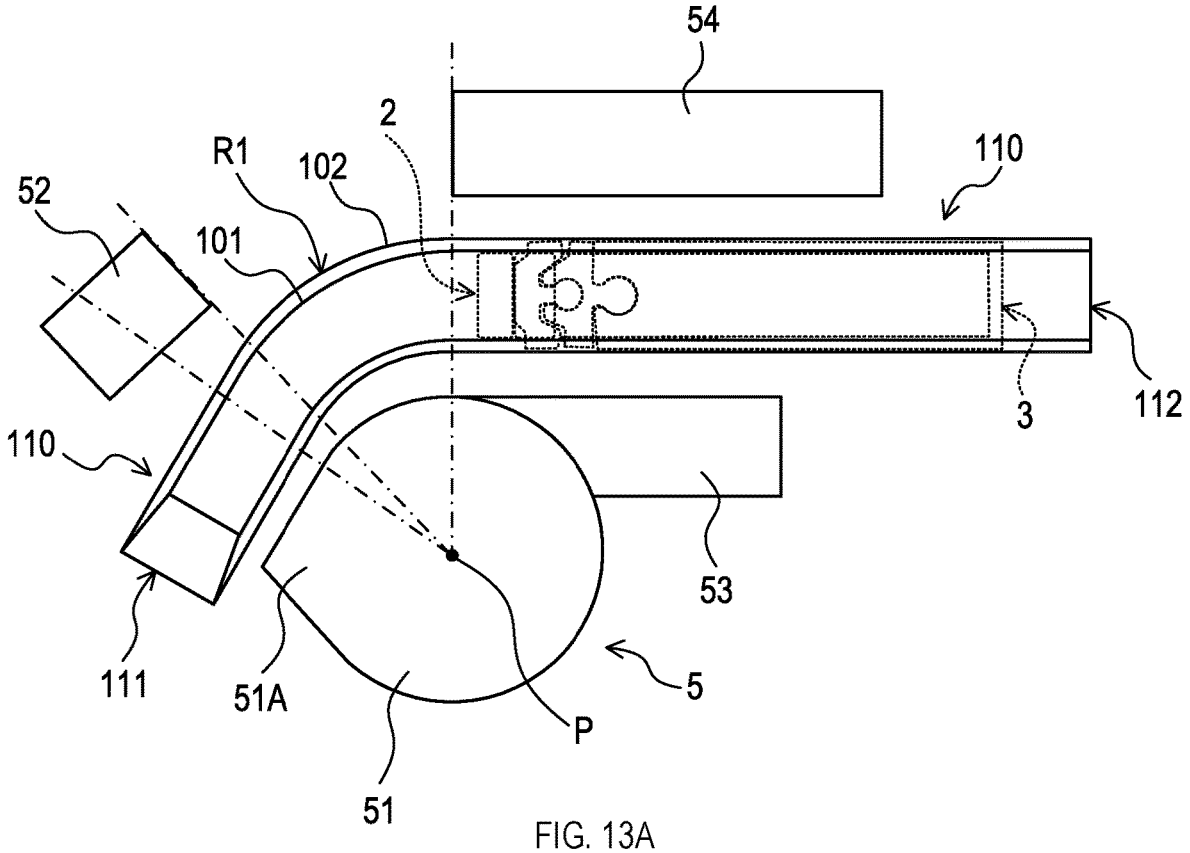
FIG. 13A is a schematic diagram explaining a process subsequent to the process of FIG. 12B.

Specifically, as shown in FIG. 13A, the first clamping portion 52 and the forwarding portion 54 are spaced apart from the double pipe 110 in the radial direction, and the double pipe 110 is spaced apart from the rotating portion 51 and also the slider 53. Furthermore, the forwarding portion 54 returns to its initial position.

Subsequently, after the rotating portion 51 and the first clamping portion 52 return to respective initial positions, the double pipe 110 is slid in the axial direction together with the inner core metal 2 and the intermediate core metal 3 to a position where the second area R2 of the double pipe 110 overlaps with the first clamping portion 52 in the radial direction (see, FIG. 5B).

Second Bending

This second bending is identical with the second bending S40 in the method of manufacturing a bent pipe of FIG. 3. Thus, description will be omitted (see, FIGS. 6A, 6B, and 7A). In the second bending S150, the first pipe 101 is bent back in the first area R1 and therefore, the size of the gap between the first pipe 101 and the second pipe 102 is modified in the first area R1.

Second Bending-Back

In this second bending-back, the second pipe 102 is bent in the second area R2 in the fourth direction D4, which is opposite to the second direction D2, after the second bending S150.

Figure 13B:
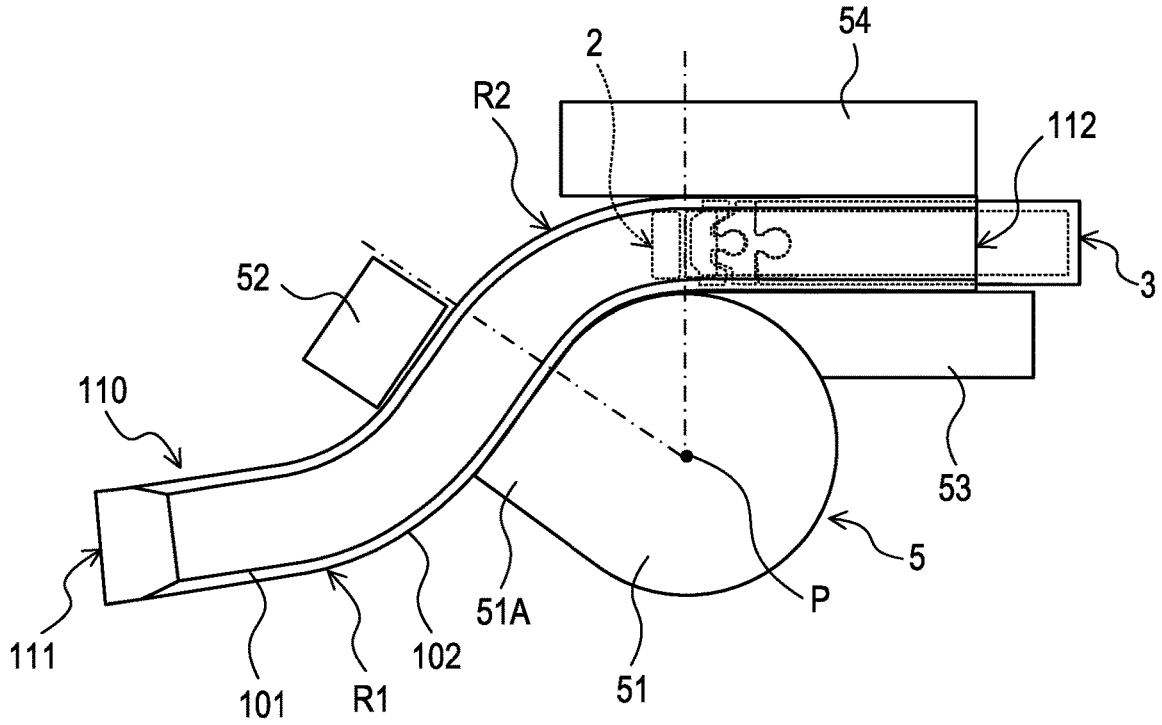
FIG. 13B is a schematic diagram explaining a process subsequent to the process of FIG. 13A.

Specifically, as shown in FIG. 13B, the inner core metal 2 and the intermediate core metal 3 first return back to respective positions that do not overlap with the second area R2. During this, the first pipe 101 is pulled by the inner core metal 2 and the intermediate core metal 3 and extends in the axial direction in the second area R2. This extension of the first pipe 101 causes the first pipe 101 to be bent back in the second area R2. As a result, the gap between the first pipe 101 and second pipe 102 is reduced in the second area R2.

Figure 14A:
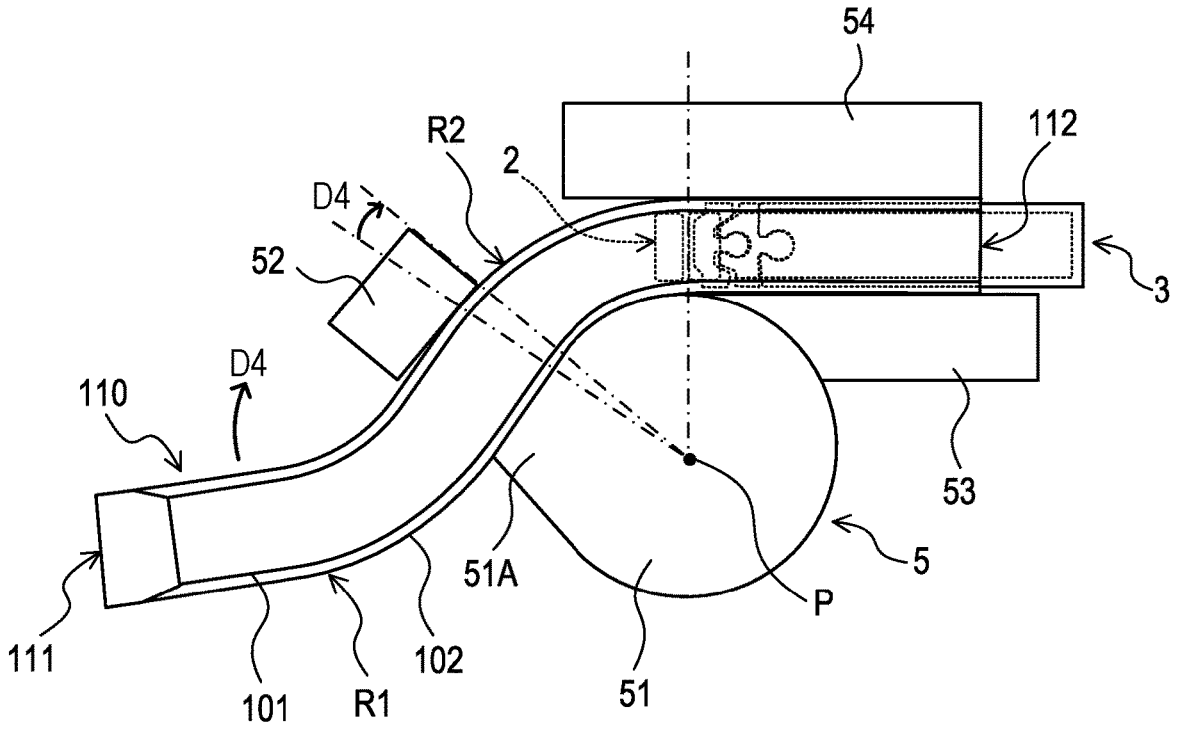
FIG. 14A is a schematic diagram explaining a process subsequent to the process of FIG. 13B.

Subsequently, as shown in FIG. 14A, the rotating portion 51 rotates in the fourth direction D4 with the chuck portion 51A and the first clamping portion 52 interposing therebetween a portion of the double pipe 110 located closer to the first area R1 than the second area R2 is. During this rotation, the inner core metal 2 and the intermediate core metal 3 are not placed in the second area R2 and therefore, only the second pipe 102 is bent in the fourth direction D4.

The second pipe 102 is bent back at a bending-back angle that substantially equalizes the bending angle of the first pipe 101 and the bending angle of the second pipe 102 to each other in the second area R2.

Removing

In this removing, the double pipe 110, which has undergone the bending and the bending-back, is removed from the inner core metal 2, the intermediate core metal 3, and the bending mold 5.

Figure 14B:
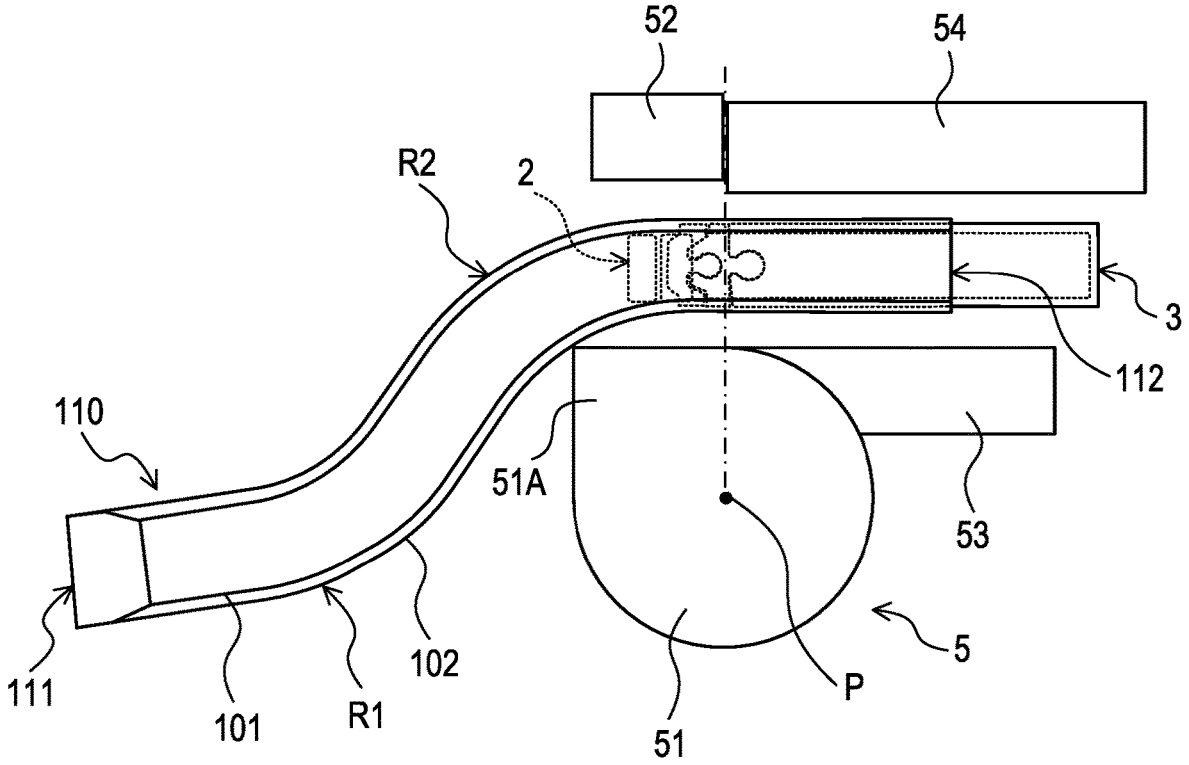
FIG. 14B is a schematic diagram explaining a process subsequent to the process of FIG. 14A.

Specifically, as shown in FIG. 14B, the first clamping portion 52 and the forwarding portion 54 are spaced apart from the double pipe 110 in the radial direction and the double pipe 110 is spaced apart from the rotating portion 51 and also the slider 53. Furthermore, the bending mold 5 returns to its initial position (that is, a position allowing the double pipe 110 to be introduced before the bending). Then, the double pipe 110 is removed from the inner core metal 2, the intermediate core metal 3, and the bending mold 5.

2-3. Effects

The embodiment detailed above can bring the following effects.

(2a) The double pipe 110 can be bent back while being placed in the bending mold 5, thereby shortening the manufacturing process of the bent pipe.

3. Other Embodiments

The embodiments of the present disclosure have been described above. However, the present disclosure is not limited to the embodiments described above and may take various forms.

(3a) In the manufacturing device for a bent pipe according to each embodiment described above, the controller may not necessarily execute the second bending-back process. In other words, the method of manufacturing a bent pipe according to each embodiment described above may not necessarily comprise the second bending-back.

(3b) In the manufacturing device for a bent pipe according to each embodiment described above, the controller may execute the bending process three times or more. In other words, the method of manufacturing a bent pipe according to each embodiment described above may comprise three or more bending.

(3c) In the manufacturing device for a bent pipe and the method of manufacturing a bent pipe according to each embodiment described above, the bending direction of the double pipe is one example. For example, the first direction and the second direction may be the same direction. Furthermore, the double pipe may be three-dimensionally bent.

(3d) Functions achieved by a single component in the above-described embodiments may be distributed to components. Functions achieved by components may be integrated into a single component. Also, a part of a configuration in the above-described embodiment may be omitted. Further, at least a part of a configuration in the above-described embodiment may be added or replaced with a configuration in other embodiments described above. Any mode included in the technical idea identified by the wordings in the claims are embodiments of the present disclosure.

What is claimed is:

1. A manufacturing device for a bent pipe by which the bent pipe is obtained by bending a double pipe with a first pipe and a second pipe containing therein the first pipe, the manufacturing device comprising:

an inner core metal configured to be placed in the first pipe;

an intermediate core metal configured to be placed between the first pipe and the second pipe;

a bending mold configured to bend the double pipe; and a controller, wherein the controller is configured to execute:

a first bending process in which the first pipe and the second pipe are bent by the bending mold in a first direction in a first area of the double pipe where the inner core metal and the intermediate core metal are placed;

a second bending process in which the first pipe and the second pipe are bent, after the first bending process, by the bending mold in a second direction in a second area of the double pipe where the inner core metal and the intermediate core metal are placed; and a first bending-back process in which the second pipe is bent, after the first bending process, in a direction opposite to the first direction in the first area.

2. The manufacturing device for a bent pipe according to claim 1, wherein the controller is configured to execute a second bending-back process in which the second pipe is bent, after the second bending process, in a direction opposite to the second direction in the second area.

3. The manufacturing device for a bent pipe according to claim 1, wherein the controller is configured to execute the first bending-back process after the second bending process.

4. The manufacturing device for a bent pipe according to claim 3, wherein the manufacturing device further comprises a bending-back mold that is configured to bend the second pipe by rotating the second pipe about the center of the first area as a fulcrum, and wherein the controller is configured to bend the second pipe by the bending-back mold in the first bending-back process.

5. The manufacturing device for a bent pipe according to claim 1, wherein the controller is configured to execute the first bending-back process before the second bending process.

6. A method of manufacturing a bent pipe in which the bent pipe is obtained by bending a double pipe with a first pipe and a second pipe containing therein the first pipe, the method comprising:

placing an inner core metal in the first pipe and placing an intermediate core metal between the first pipe and the second pipe, bending the first pipe and the second pipe by a bending mold in a first direction in a first area of the double pipe where the inner core metal and the intermediate core metal are placed;

bending the first pipe and the second pipe, after the bending in the first direction, by the bending mold in a second direction in a second area of the double pipe where the inner core metal and the intermediate core metal are placed; and bending-back the second pipe, after the bending in the first direction, in a direction opposite to the first direction in the first area.

* * * * *